United States Patent [19]

Orlandi et al.

[11] 4,300,339

[45] Nov. 17, 1981

[54] SYSTEM FOR STRANDING AND CABLING ELONGATE FILAMENTS

[75] Inventors: John F. Orlandi, Lombard; Timothy J. Moore, Elgin, both of Ill.

[73] Assignee: Belden Corporation, Geneva, Ill.

[21] Appl. No.: 53,024

[22] Filed: Jun. 28, 1979

[51] Int. Cl.[3] ..... D07B 3/04

[52] U.S. Cl. ..... 57/58.34; 57/15; 57/58.36; 57/58.55

[58] Field of Search ..... 57/13–15, 57/58.32, 58.34, 58.36, 58.52, 58.55, 58.57, 58.3, 58.38

[56] References Cited

U.S. PATENT DOCUMENTS

| | | | |
|---|---|---|---|
| 1,378,932 | 5/1921 | Anderson | 57/58.36 |
| 1,866,272 | 7/1932 | Seeley | 57/58.52 |
| 2,331,648 | 10/1943 | Berggren et al. | 57/58.57 |
| 2,464,860 | 3/1949 | Green | 57/58.52 |
| 3,286,451 | 11/1966 | Woolman | 57/58.32 |
| 3,425,203 | 2/1969 | Schillebeeckx | 57/58.55 X |
| 3,456,433 | 7/1969 | Huwaert | 57/58.34 X |
| 3,827,225 | 8/1974 | Schoerner | 57/58.34 X |
| 3,867,809 | 2/1975 | Holbrook | 57/58.52 |
| 3,955,348 | 5/1976 | Orlandi | 57/13 |

*Primary Examiner*—John Petrakes

*Attorney, Agent, or Firm*—Fitch, Even, Tabin, Flannery & Welsh

[57] ABSTRACT

A system for stranding and cabling elongate filaments in a single operation wherein a plurality of modules are adapted for end-to-end alignment and each module includes a carriage supporting a plurality of supply reels from which elongate filaments are drawn off and guided to a rotating flier guide which effects stranding of the filaments and guides the stranded filaments to the next successive module. The stranded filaments from the various modules are guided to a cabling station which includes a closing die and drive capstan operative to effect cabling of the stranded filaments.

12 Claims, 10 Drawing Figures

SYSTEM FOR STRANDING AND CABLING ELONGATE FILAMENTS

The present invention relates generally to stranding and cabling systems, and more particularly to a novel stranding and cabling system employing a plurality of aligned stranding modules from which stranded filaments are passed to a cabling station cooperative with the various modules to provide a compact highly efficient system for stranding and cabling stranded filaments in a single operation.

Systems are known which are capable of stranding and cabling elongate filaments, such as wire, in a substantially single operation. See, for example, U.S. Pat. No. 4,073,127, to Orlandi et al., assigned to the assignee of the present invention, and U.S. Pat. No. 3,425,203 to K. C. Schillebeeckx. A very desirable feature of any stranding and cabling system is that it be of compact size and construction to enable economical shipment and installation with minimum floor space occupancy. Another desirable feature of such systems is that they be capable of producing various size cable without wasteful energy as would result if portions of the system were caused to go through their operating cycles but without contributing to the production of cable. For example, the aforenoted Schillebeeckx patent discloses a cable making machine which employs a one piece rotating frame. The frame must be made sufficiently long to accommodate the largest number of twisted pairs which may be run with the machine. Such a machine poses severe problems in shipment and installation.

One of the primary objects of the present invention is to provide a novel stranding and cabling system which is capable of stranding and cabling elongate filaments in a single operation in a highly efficient and economical manner.

A more particular object of the present invention is to provide an improved system for stranding and cabling elongate filaments which employs a plurality of individually cooperating modules each of which is adapted to strand a plurality of elongate filaments and pass the stranded filaments to the next serially disposed module which in turn produces a standard filament and passes the individual stranded filaments to the next serially related module until the desired number of stranded filaments is obtained whereupon the filaments are passed to a cabling station to cable the strands from the serially positioned modules.

A feature of the stranding and cabling system in accordance with the present invention lies in the provision of modules adapted for selective serial interrelation to enable a selection of modules as necessary to produce a predetermined size cable or cordage, and wherein the modules facilitate positioning in various configurations, such as straight line, L or U configurations, to accommodate different floor space restrictions in a very economical manner. This feature is particularly desirable to minimize the number of bends in the guide path through which stranded filaments are guided to the cabling station. This is particularly desirable when stranding and cabling wire filaments so as to reduce any chance of work hardening of the wire filaments.

Still another object of the present invention is to provide a novel module for stranding two or more elongate filaments wherein the module includes a floating carriage adapted to support at least two filament supply reels, the carriage being supported interiorly of a rotatable flier guide operative to strand the filaments as they are drawn from corresponding supply reels under substantially constant tension, and wherein the module is adapted for serial interconnection to similar modules in a cable making system.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
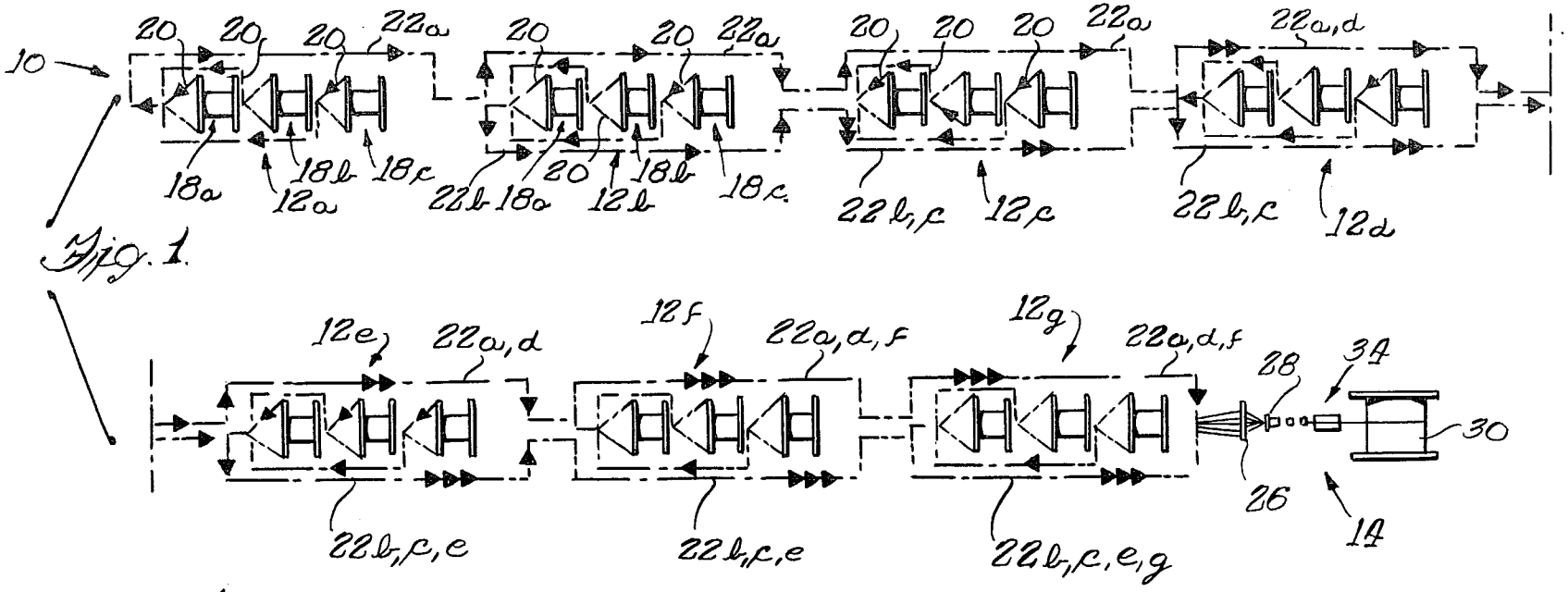
FIG. 1 is a schematic view illustrating a stranding and cabling system in accordance with the present invention employing seven stranding modules serially interrelated upstream of a cabling station.

Referring now to the drawings, and in particular to FIG. 1, a system for stranding and cabling elongate filaments in accordance with the present invention is indicated generally at 10. Very generally, the stranding and cabling system 10 includes a plurality of similar stranding modules 12*a–g* which are serially interrelated in end-to-end relation and operatively associated with a cabling station indicated at 14. In the illustrated embodiment, the stranding modules 12*a–g* are disposed in substantially axially aligned relation with the last module 12*g* of the serially related modules being termed the "downstream" module and all stranding modules serially preceding module 12*g* being progressively "upstream" from the cabling station 14.

As used herein, the term "filament" or "elongate filament" is meant to include wire filaments and nonwire filaments such as nonmetallic elongate strength members or filler elements as conventionally employed in making portable cordage. For purposes of illustration, however, the stranding and cabling system 10 will be described in connection with stranding elongate wire filaments and cabling the stranded wire filaments in a single operation into a desired cable size corresponding to selected AWG size cable.

Figure 5A:
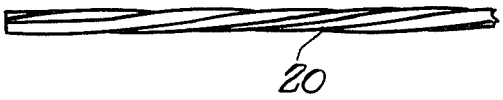
FIGS. 5*a*, 5*b*, 6*a*, 6*b* and 7*a*, 7*b* illustrate various stages of the elongate filaments during stranding and cabling thereof in accordance with the present invention.
Figure 5B:
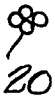

Each of the stranding modules 12*a–g* includes a plurality of identical filament supply reels which may have elongate wire filaments wound thereon in a known manner. In the illustrated embodiment, each of the cabling modules 12*a–g* has three filament supply reels 18*a*, *b* and *c* operatively associated therewith, each of the filament supply reels having an elongate filament 20 wound thereon in a conventional manner. The elongate filaments 20 may comprise individual wire filaments or may comprise a plurality, such as four, of wire filaments which are prestranded together prior to winding on the associated supply reels so as to form a wire cord which when wound upon its corresponding supply reel may be withdrawn for stranding or twining with the elongate filaments drawn from the other two supply reels within the corresponding stranding module. For example, the elongate filament 20 wound on each of the supply reels 18*a, b* and *c* of stranding module 12*a* may comprise a four stranded core filament as illustrated in FIGS. 5*a* and 5*b*.

Figure 6A:
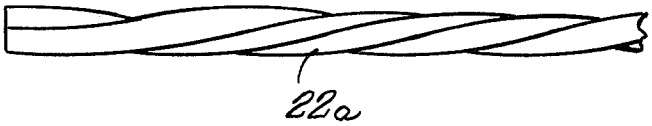
Figure 6B:
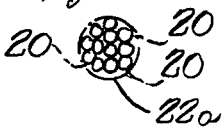
Figure 7A:
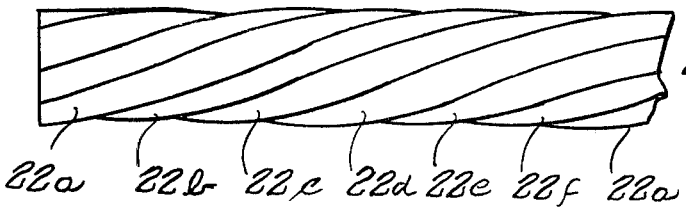
Figure 7B:
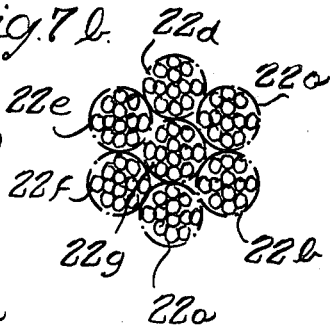

The filaments drawn from the supply reels 18*a, b* and *c* are stranded by the stranding module 12*a* to form a twelve stranded core filament 22*a*, as illustrated in FIGS. 6*a* and 6*b*, which, as will be described more fully hereinbelow, is guided to the second serially related stranding module 12*b* where it is guided around the supply reels 18*a*, 18*b* and 18*c* of module 12*b* in substantially parallel but separate relation to a stranded filament 22*b* formed from the filaments 20 wound on the reels 18*a, b* and *c* of module 12*b*.

The stranded filaments 22*a* and 22*b*, which comprise twelve stranded cord filaments each, are guided to the third serially interrelated stranding module 12*c* which guides the stranded filament 22*a* around the filament supply reels 18*a*, 18*b* and 18*c* of module 12*c* in parallel but separate relation to the afore-formed stranded filament 22*b* and a stranded filament 22*c* formed from the individual filaments 20 drawn from the filament supply reels 18*a–c* of module 12*c*. In the illustrated embodiment, this procedure is repeated by successive ones of the stranding modules 12*b–g* to ultimately form seven separate stranded filaments 22*a–g* which exit from the last of the serially interrelated modules where they are passed through a separator plate 26 and through a closing die 28 which serves to helically cable six of the stranded filaments, such as 22*a–f*, about an axially disposed stranded filament, such as 22*g*, after which the cabled filaments are taken up on a take-up spool or reel 30. Capstan drive means 34 are interposed between the closing die 28 and the take-up spool or reel 30 and are operatively associated with the cabled filaments so as to draw the elongate filaments from the filament supply reels in the various stranding modules 12*a–g* and feed the cable to the take-up spool 30.

In accordance with one feature of the present invention, the stranding modules 12*a–g* may be arranged in substantially any desired serially end-to-end arrangement so as to provide a substantially axially aligned arrangement, as illustrated in FIG. 1, or to provide an "L" or "U" shaped plan configuration without adversely affecting the efficiency of stranding and cabling. This is particularly desirable to enable maximum utilization of floor space as may be available within a manufacturing facility, and particularly where such floor space does not allow axial end-to-end alignment of the stranding modules. Another benefit deriving from the employment of stranding modules in accordance with the invention lies in utilizing in the system only the number of stranding modules required to provide the ultimate cable size desired. In this manner, the stranded filaments produced by the stranding modules do not have to pass through modules which are not themselves producing stranded filaments for the final cable produced, with result that the number of bends which the stranded filaments undergo as they pass through successive modules to the cabling station is minimized so as to minimize work hardening of the metallic wire filaments. Also, by eliminating stranding modules which are not contributing a stranded filament to the ultimate wire cable, energy which might otherwise be necessary to effect operation of various components of the nonused modules is not wasted.

Figure 3:
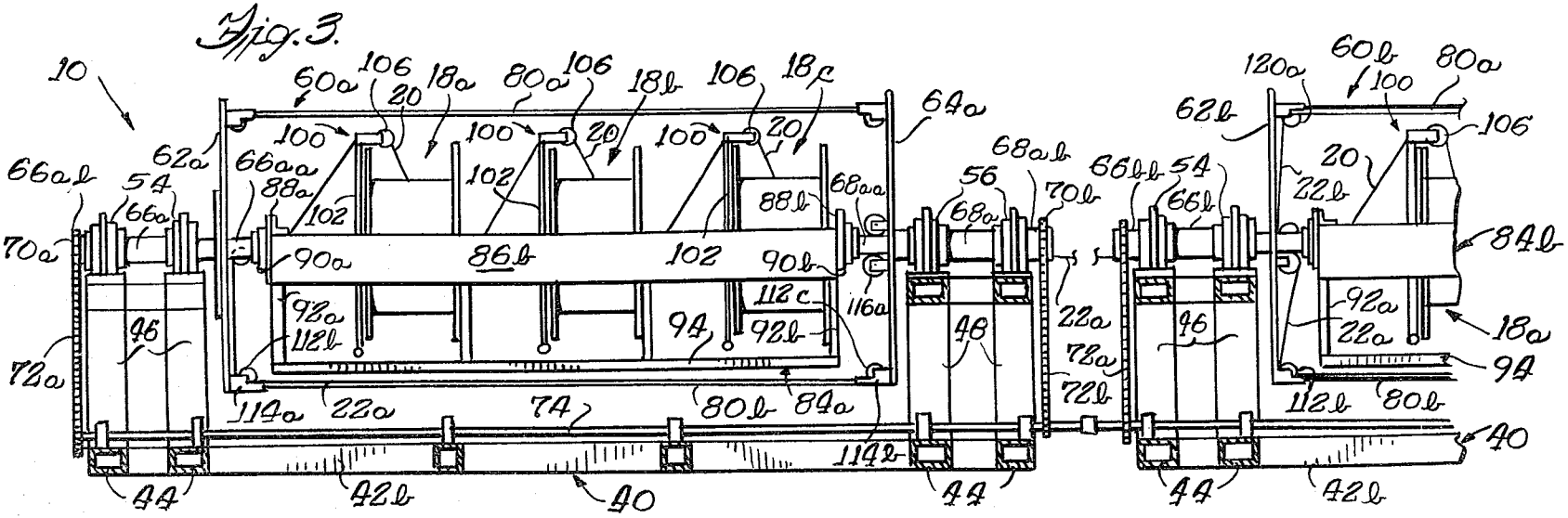
FIG. 3 is a fragmentary elevational view of the first and a portion of the second stranding modules of FIG. 2, taken substantially along line 3—3 of FIG. 2, but with the filament let-off fliers rotated 90 degrees from their positions in FIG. 2.
Figure 2:
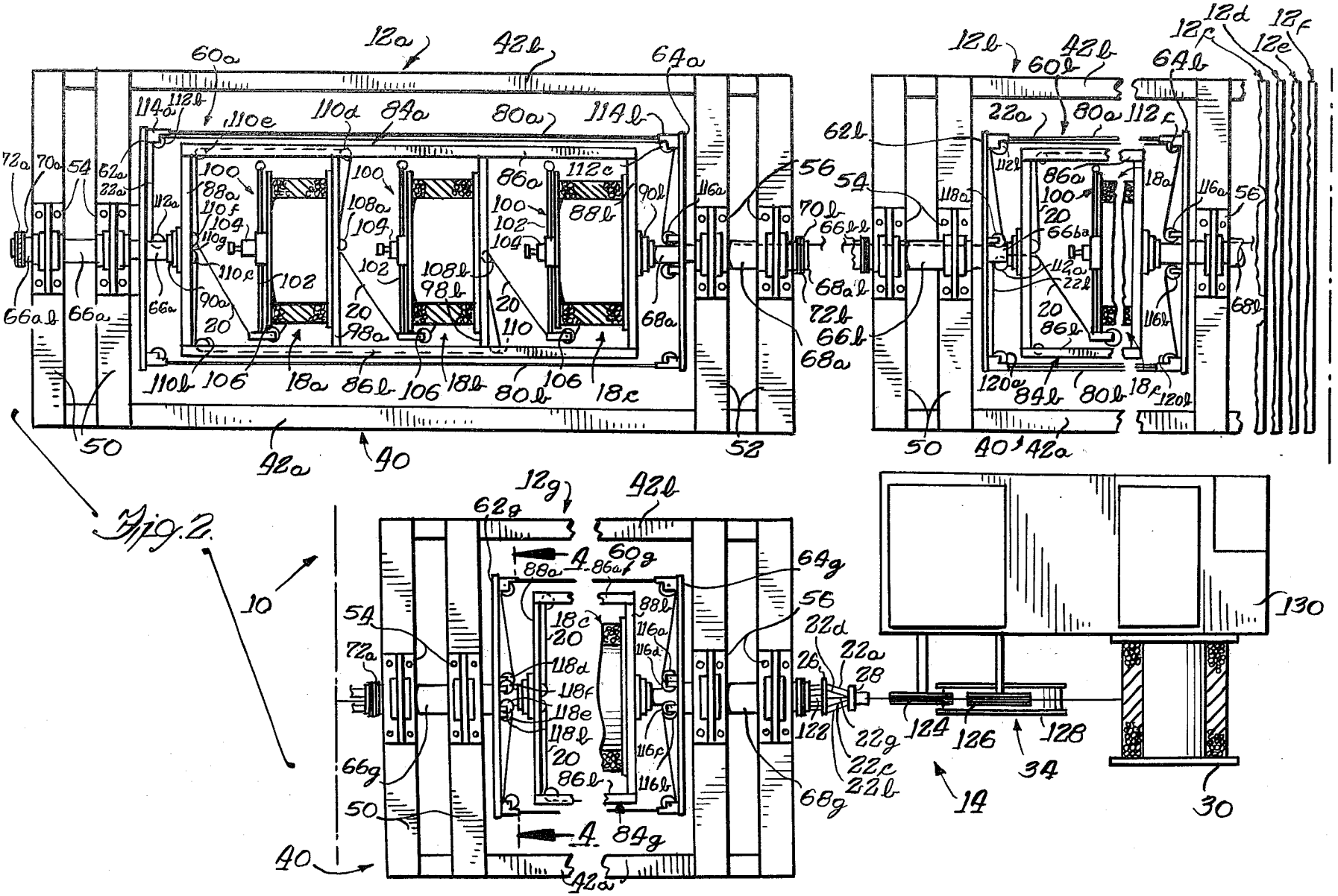
FIG. 2 is a fragmentary plan view, on an enlarged scale, of the stranding and cabling system illustrated schematically in FIG. 1.
Figure 4:
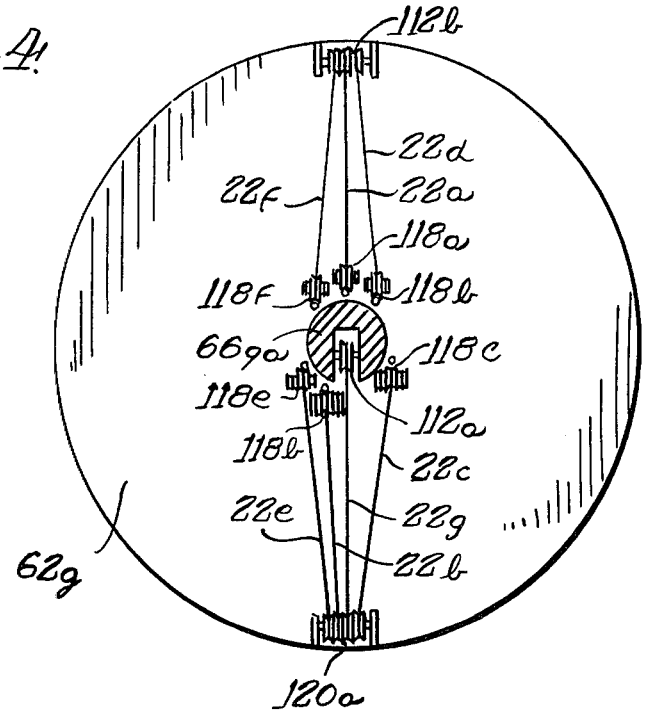
FIG. 4 is a fragmentary transverse sectional view taken substantially along line 4—4 of FIG. 2.

Turning now to a more detailed description of the stranding and cabling system 10, the stranding module 12*a* will be described in detail as being generally representative of all of the stranding modules 12*a–g*. With particular reference to FIGS. 2–4, each of the stranding modules 12*a–g* includes frame means in the form of a base frame having at least two longitudinally extending laterally spaced frame members 42*a*, 42*b* which are interconnected at their opposite ends by transverse frame members 44. Laterally spaced pairs of upstanding frame members 46 and 48 are secured to the opposite ends of the longitudinal frame members 42*a, b* and support pairs of horizontal transverse frame members 50 and 52, respectively, which, in turn, support axially aligned parts of bearings 54 and 56. The axis of the aligned pairs of bearings 54 and 56 defines the longitudinal axis of the base frame 40 and, correspondingly, the longitudinal axis of the stranding module 12*a*.

The base frame 40 rotatably supports flier guide means 60*a* for rotation about the longitudinal axis of the stranding module 12*a*. The flier guide means 60*a* includes a pair of longitudinally spaced parallel flier plates 62*a* and 64*a* each of which is affixed in normal relation to a support shaft 66*a* and 68*a*, respectively, rotatable within a corresponding pair of bearings 54 and 56. The support shaft 66*a* and 68*a* are secured to the respective flier plates 62*a* and 64*a* at the centers of the flier plates and have reduced diameter end portions 66*aa* and 68*aa*, respectively, which extend through the flier plates a predetermined distance as will be described more fully hereinbelow. Each of the support shafts 66*a* and 68*a* extends axially outwardly of the outermost one of its associated support bearings 54 and 56, as indicated at 66*ab* and 68*ab* so as to support a drive pulley 70*a* and 70*b*, respectively, thereon. The drive pulleys 70*a* and 70*b* have driving connection through drive belts 72*a* and 72*b*, respectively, with a common drive shaft 74 mounted on the base frame 40 and extending longitudinally thereof. The drive shaft 74 is connected to a suitable drive motor (not shown) to effect rotation of the flier plates 62*a* and 64*a* at a selected predetermined rotational speed.

The flier plates 62*a* and 64*b* are preferably circular and support pairs of closely spaced high strength cables 80*a* and 80*b* in diametrically opposed relation therebetween, the cables 80*a* and 80*b* preferably being high strength aircraft type cables which are secured at their opposite ends to the flier plates so as to extend in taut relation parallel to the axis of rotation of the flier plates. The pairs of the cables 80*a*, 80*b* have filament guides (not shown) mounted in spaced relation thereon in a manner similar to the filament guides identified at reference numeral 186 in the aforenoted U.S. Pat. No. 4,073,127 which is incorporated herein by reference. In stranding module 12*a*, only one pair of the cables 80*a, b* need have filament guides mounted thereon, while in the remaining stranding modules 12*b–g*, filament guides are provided along each pair of cables. As will be described more fully hereinbelow, the flier guide means 60*a* of the stranding module 12*a* is adapted to guide a stranded filament between the longitudinally spaced flier plates 62*a* and 64*a* along one of the cables 80*a*, 80*b*.

Each of the stranding modules 12*a–g* also includes carriage means, indicated generally at 84*a–g*, respectively, which is supported by the corresponding frame means 40 interiorly of the cylindrical envelope defined by the path of travel of the flier cables 80*a, b* and is adapted to "float" relative to the base frame during operation of the stranding module. The carriage means 84*a* of stranding module 12*a*, which may alternatively be termed a supply reel or spool support carriage, includes a carriage frame having longitudinally extending frame channels 86*a* and 86*b* the opposite ends of which are secured to transverse channels 88*a* and 88*b* so as to form a rectangular framework as best seen in plan in FIG. 2. Suitable bearings 90*a* and 90*b* are affixed to the outwardly facing surfaces of the transverse frame channels 88*a* and 88*b* centrally thereof and are rotatably supported on the reduced diameter ends 66*aa* and 68*aa*, respectively, of the flier guide support shafts 66*a* and 68*a*. A pair of frame members 92*a* and 92*b* are affixed in normal relation to the centers of transverse channels 88*a* and 88*b*, respectively, so as to lie in coplanar relation therewith. The lower ends of the frame members 92*a, b* are affixed to a longitudinally extending channel 94 which, with the associated frame members 92*a, b*, provide sufficient weight to prevent free rotation of the carriage frame relative to the base frame 40, thus insuring nonrotating "floating" support of the carriage means.

As aforementioned, each of the stranding modules 12*a–g* is adapted to support three filament supply reels or spools 18*a, b* and *c* in a manner to enable let-off of an elongate filament 20 from each of the supply reels. In the illustrated embodiment, each reel support carriage 84*a–g* has a pair of transverse channels 98*a* and 98*b* secured to and between the longitudinal frame channels 86*a, b* in parallel spaced relation to the transverse end channels 88*a, b* so as to establish three substantially equal sections along the length of the support carriage. The transverse channels 88*b*, 98*a* and 98*b* are each adapted to support a filament supply reel so that the axis of the reels is coincident with the axis of rotation of the flier guide means 60. The filament supply reels 18*a, b* and *c* are nonrotatably supported by the transverse channels 98*a, b* and 88*b*, respectively, by suitable means of conventional design which allow release of the reels for interchanging when the elongate filaments wound thereon are substantially depleted. An example of a suitable manner of releasably mounting the supply reels to the support carriages 84 is disclosed in the aforementioned U.S. Pat. No. 4,073,127 except that in the instant embodiment, the filament supply reels are nonrotatably supported and need not have stability counterweights affixed thereto.

Each of the filament supply reels 18*a, b* and *c* has payoff flier means 100 operatively associated therewith for guiding cooperation with the corresponding elongate filament 20 wound on the supply reel so that the filament may be let-off or paid-off from the associated supply reel under substantially constant axial tension when the filament is subjected to an axial force sufficient to draw it from its supply reel. Each payoff flier means 100 includes a flier arm 102 which is rotatably mounted on a support collar 104 adapted for releasable mounting on the associated filament supply reel in a manner as disclosed in incorporated U.S. Pat. No. 4,073,127. For example, each filament supply reel 18*a, b* and *c* may be mounted on its corresponding transverse support channel 98*a, b* or 88*b*, through a support shaft fixed centrally on the corresponding transverse support channel and received through a suitable axial bore or passage in the supply reel. Each payoff flier 100 may then be releasably mounted on its associated supply reel prior to loading the reels onto the reel support carriages 84*a–g*.

Each payoff flier arm 102 rotatably supports a suitable peripherally grooved guide pulley 106 at a radial outer end thereof spaced slightly radially outwardly from the circumferential edge of the adjacent side wall or flange of the associated supply reel so that the guide pulley 106 receives the corresponding elongate filament 20 in guided relation thereon. The payoff fliers enable withdrawing of the elongate filaments from the supply reels under substantially constant axial tension when the filaments are subjected to axial pulling forces from the capstan drive means 34 as is known. It will be appreciated that drawing the elongate filaments 20 axially over the guide pulleys 106 causes the flier means 100 to rotate whereby to facilitate unwinding and pay-out of the elongate filaments from their associated supply reels.

As the elongate filaments 20 are drawn from their respective supply reels 18*a, b* and *c*, they are guided to a predetermined common end of the associated reel support carriage 84*a–g* at which point the three elongate filaments are stranded generally helically about each other in a predetermined lay dependent upon the rate of drawing the filaments from the supply reels and the rate of rotation of the corresponding flier guide means 60*a–g*. Referring to FIG. 2 and stranding module 12*a*, the elongate filaments 20 are guided from the supply reels 18*a, b* and *c* to a predetermined end of the support carriage 84*a* which, in the illustrated embodiment, is the rear or "upstream" end of the support carriage, by first guide means in the form of a plurality of guide rollers operatively associated with each of the elongate filaments so as to guide them to the selected end of the support carriage. To this end, each transverse frame channel 98*a* and 98*b* rotatably supports a peripherally grooved guide pulley 108*a* and 108*b*, respectively, centrally thereof. The elongate filament 20 drawn from the supply reel 18*c* is guided over the corresponding guide pulley 106 inwardly to the associated guide pulley 108*b* from which it is guided generally radially outwardly about a guide pulley 110*a* carried on the frame channel 86*b* and along the longitudinal channel 86*b* to and about a guide pulley 110*b* from which it is guided inwardly to and about a guide pulley 110*c* rotatably supported by and at substantially the center of the transverse channel 88*a*. From the guide pulley 110*c*, the elongate filament from the supply reel 18*c* is passed through a central opening in the transverse channel 88*a* and into an axial passage in the end 66*aa* of the flier guide support shaft 66*a*.

In similar fashion, the elongate filament 20 from the supply reel 18*b* is guided about its corresponding payoff arm guide pulley 106 and inwardly to and about the guide pulley 108*a* from which the filament is passed outwardly to and about a guide pulley 110*d* carried on the carriage frame channel 86*a*. From guide pulley 110*d*, the filament passes along channel 86*a* to and about a guide pulley 110*e* from which it is guided radially inwardly to and about a guide pulley 110*f* rotatably supported on the transverse channel 88*a* adjacent its center. From the guide pulley 110*f*, the elongate filament from the supply reel 18*b* is also passed through the central opening in channel 88*a* and into the axial passage in the shaft 66*a*.

Also in similar fashion, the elongate filament 20 from the filament supply reel 18*a* is guided about the associated payoff flier guide pulley 106 and inwardly to and about a guide pulley 110*g* rotatably supported on the transverse channel 88*a* adjacent the center opening therein through which the filament is passed with the elongate filaments from the supply reels 18*b* and 18*c* into the axial passage in support shaft 66*aa*.

During operation of the stranding module 12*a*, the flier guide means 60*a* is rotatably driven at a predetermined rotational speed through the drive shaft 74. Because the reel support carriage 84 remains generally stationary relative to the base frame 40, rotation of the flier guide means 60*a* effects stranding or twining of the three elongate filaments 20 fed into the axial passage in the guide shaft 66*aa* from the supply reels 18*a, b* and *c*, so that a predetermined lay is established between the stranded filaments. After the three elongate filaments 20 are stranded together within the rotating support shaft 66*aa*, the resulting stranded filament 22*a* is guided about a guide pulley 112*a* rotatable within a suitable radial groove or slot in shaft 66*aa*. From pulley 112*a* the stranded filament is guided radially outwardly about a guide pulley 112*b* rotatably carried in a bracket 114*a* fixed on the flier plate 62*a* adjacent its outer edge and to which ends of cables 80*b* are secured. From the guide pulley 112*b*, the stranded filament is guided along the pair of guide cables 80*b* through guides as aforementioned and about a guide pulley 112*c* rotatably carried in a bracket 114*b* fixed on the flier plate 64*a* and to which the opposite ends of the cables 80*b* are secured. The stranded filament is thereafter guided generally radially inwardly to and about a guide pulley 116*a* rotatably supported on the filter plate 64*a* adjacent the support shaft 68*aa*.

The stranded filament 22*a* from the stranding module 12*a* is passed from the guide pulley 116*a* through a suitable longitudinal passage in the support shaft 68*a* to enable passage to the next success stranding module 12*b*, in similar fashion to passage of filaments through the sleeves 133 disclosed in U.S. Pat. No. 3,955,348, assigned to the assignee of the present invention and incorporated herein by reference. As the stranded filament 22*a* exits from the stranding module 12*a* it is passed through a suitable longitudinal passage (not shown) in the flier guide support shaft 66*b* of the stranding module 12*b* whereupon the stranded filament is guided about a guide pulley 118*a* rotatably carried on the flier plate 62*b* of the flier guide means 60*b* adjacent the corresponding support shaft end 66*ba*. The stranded filament 22*a* passes generally radially outwardly from the guide pulley 118*a* and is guided over pulleys 112*b*, 112*c* and 116*a* carried on the flier guide means 60*b* so as to pass around the filament supply reels 18*a, b* and *c* carried by the reel support carriage 84*b* of module 12*b* whereafter filament 22*a* passes through a passage in the opposite flier guide support shaft 68*b* to the next successive stranding module 12*c*, as illustrated schematically in FIG. 1.

Simultaneously, elongate filaments 20 are drawn from three supply reels 18*a, b*, and *c* carried on the floating reel support carriage 84*b* of stranding module 12*b* and are guided to the center of the transverse carriage frame channel 88*a* and into an axial passage in support shaft 66*b* where they are stranded or twined together as the flier guide 60*b* is rotatably driven by drive shaft 74 in similar fashion to and at the same rotational speed as the flier guide 60*a* of module 12*a*. The stranded filament 22*b* formed by stranding module 12*b* is then guided over pulley 112*a* radially outwardly to the pair of guide cables 80*b* of flier guide means 60*b* and along the guide cables to the opposite end of the stranding module 12*b* over guide pulleys 120*a* and 120*b* on the flier plates 62*b* and 64*b* where it is guided inwardly and over a guide pulley 116*b* and through the support shaft 68*b* to the next successive stranding module 12*c*.

In this manner, each stranding module is adapted to strand three elongate filaments while simultaneously passing all stranded filaments received from the next upstream stranding module about the filament supply reels carried thereon so that the stranded filaments are guided through successive stranding modules as separate discrete filaments. The filament guide pulleys carried by the flier plates 62*a–g* and 64*a–g* and the filament guides carried on the pairs of cables 80*a, b* of the flier guide means 60*a–g* constitute second guide means for the respective stranding modules. The drive shafts 74 of the respective stranding modules 12*a–g* may be suitably coupled in a coventional manner.

In order to maintain the various stranded filaments 22*a–g* in separated relation from each other as they pass through successive ones of the serially interrelated stranding modules 12*b–g*, the guide pulleys 112*b, c* and 120*a, b* carried at the outer edges of the rotating flier plates 62*c–g* and 64*c–g* associated with each successive stranding module after the second module 12*b* comprise multi-grooved guide pulleys over which individual incoming stranded filaments are guided from substantially the axis of the input end of a given stranding module to substantially the axis of the exit end thereof. For example, the guide pulleys 112*b* and 112*c* of module 12*a* and guide pulleys 112*b, c* and 120*a, b* of module 12*b* may comprise single groove pulleys, while the flier guide of the stranding module 12*c* employs one set of single groove pulleys to guide the stranded filament 22*a* and one set of double grooved pulleys to guide the stranded filaments 22*b* and 22*c*. Stranding module 12*d* correspondingly requires double grooved pulleys 112*b, c* and 120*a, b* for each flier guide path to guide the strands 22*a, c* and 22*b, c* in separated relation, while module 12*e* requires one set of double grooved pulleys and one set of triple grooved pulleys, etc., to module 12*g* which requires one set of triple groove guide pulleys for stranded filaments 22*a, d* and *f* and one set quadruple groove guide pulleys for stranded filaments 22*b, c, e* and *g*. Similarly, the filament guides on the pairs of guide cables 80*a, b* are adapted to guide the multiple lengths of stranded filaments produced by successive stranding modules.

With particular reference to FIG. 4, it is seen that for the stranding module 12*g*, the flier plate 62*g*, which handles the maximum number of incoming stranded filaments in the illustrated embodiment, has six single groove guide pulleys 118*a–f* rotatably supported adjacent the associated support shaft 66*ga* with each of the guide pulleys 118*a–f* being adapted to receive one of the stranded filaments 22*a–f* in guided relation thereover as the stranded filaments pass from the associated passages in the flier guide support shaft 66*g* of module 12*g*. It will be appreciated that the flier plate 62 and associated support shaft 66 of each successive stranding module must be capable of receiving and guiding one additional stranded filament over the number handled by the next preceding module, although the flier support shafts 66*g* and 68*g* of module 12*g* may be employed in the preceding modules 12*a–f*, if desired.

From the guide pulleys 118*a–g* on the flier plate 62*g* and guide pulley 112*a* on shaft 66*ga* of stranding module 12*g*, the stranded filaments 22*a–g* are guided substantially radially outwardly and over corresponding suitable multiple grooved guide pulleys rotatably supported at diametrically opposite edges of the flier plates 62*g* and 64*g*, after which the stranded filaments are guided inwardly about single groove guide pulleys 116*a–f* rotatably mounted adjacent the axis of the flier plate 64*g* in similar fashion to the guide pulleys 118*a–g* on flier plate 62*g*. The stranded filaments 22*a–g* are then passed through longitudinal passages in the flier support shaft 68*g*. The stranded filaments 22*a–g* are thus maintained in discrete separated relation as they are guided through the stranding module 12*g*.

As the stranded filaments 22*a–g* exit from the stranding module 12*g*, they are passed through the circular separator plate 26 which is of conventional design and has a number of individual openings spaced circumferentially about its axis so that each opening receives one of the stranded filaments 22*a–f* therethrough. In the illustrated embodiment, the separator plate 26 is mounted on a support shaft 122 in normal relation thereto. The support shaft 122 is supported coaxially by and rotatable with the flier guide support shaft 68*g* so that the separator plate is spaced longitudinally from the stranding module 12*g*. The stranded filament 22*g* made by stranding module 12*g* is passed axially through the corresponding flier support shaft 68*g* and through an axial passage in the support shaft 122 and separator plate 26 to enable cabling of six stranded filaments about one axial stranded filament. The separator plate 26 thus has six circumferentially spaced openings therethrough spaced radially from an axial opening through which the stranded filament 22*g* passes.

The stranded filaments 22*a–g* pass from the separator plate 26 through the closing die 28 which, as noted, is of conventional design and serves to close the rotating stranded filaments 22*a–f* in cabled relation about the axial stranded filament 22*g* so as to form a "six about one" cable. The cable so formed is passed between conventional drive pulleys 124 and 126 and a capstan drive wheel 128 which cooperate to define the capstan drive means 34 and are operative to pull the stranded filaments through the various stranding modules 12*a–g*. The cable thus formed is wound on the take-up spool 30 which is preferably releasably mounted on a take-up spool drive means 130 of known design operative to rotate the take-up spool and wind the formed cable thereon.

Thus, in accordance with the present invention, a system for stranding elongate filaments and cabling the various stranded filaments in a single operation is provided wherein a plurality of stranding modules are provided each of which is adapted to form a stranded filament of the final formed cable. After the elongate filaments are drawn from filament supply reels and stranded within each stranding module, the stranded filaments are passed through successive serially positioned stranding modules to a cabling station where the individual stranded filaments are cabled. In the illustrated embodiment, six stranded filaments are cabled about an axial stranded filament so as to form a six about one cable.

A significant feature of the invention is that the number of stranding modules employed may be varied to obtain the exact AWG size cable desired without wasteful energy utilization and with optimum floor space occupancy. The use of separate stranding modules also enables interrelation in various plan configurations such as straight line, "L" or "U" configurations while maintaining necessary end-to-end relation of successive stranding modules.

While a preferred embodiment of the invention has been illustrated and described, it will be understood to those skilled in the art that changes and modifications may be made therein without departing from the invention in its broader aspects. Various features of the invention are defined in the following claims.

What is claimed is:

1. A system for stranding elongate filaments and cabling the stranded filaments into an elongate cable, said system comprising, in combination, a plurality of stranding modules each of which includes frame means defining a longitudinal axis and is adapted for end-to-end positioning with similar modules so as to establish a plurality of serially related stranding modules, each of said stranding modules further including flier guide means supported by the associated frame means for rotation about an axis substantially parallel to the longitudinal axis of the associated frame means, carriage means supported by each of said frame means interiorly of the associated flier guide means during rotation thereof, said carriage means being adapted to remain substantially stationary relative to said frame means during rotation of the associated flier guide means, at least two filament supply reels releasably mounted on each of said carriage means, each of said supply reels being adapted to support an elongate filament in wound relation thereon and being mounted on its associated carriage means so that the axis of each supply reel is substantially coaxial with the axis of rotation of the corresponding flier guide means, a plurality of guide rollers carried by each of said carriage means for receiving and guiding a filament from each of the corresponding filament supply reels to substantially the axis of rotation of a predetermined end of said carriage means, payoff flier means including a radially disposed flier arm operatively associated with each of said supply reels and having guide means at its radial outer end for guiding cooperation with the corresponding elongate filament so that said filament is paid out from the associated supply reel under substantially constant axial tension when the filament is subjected to an axial force sufficient to draw it from its associated supply reel, drive means independently operatively associated with each of said flier guide means for effecting predetermined rotation thereof relative to the associated frame means so as to strand the filaments from the corresponding supply reels to form a stranded filament at said predetermined end of each of said carriage means, second guide means carried by each of said flier guide means for guiding the corresponding formed stranded filament from said predetermined end of said carriage means to an outlet end of the associated frame means during rotation of said flier guide means, said outlet end being disposed longitudinally opposite said predetermined end of said carriage means, said carriage means including a carriage frame having axially extending support shafts affixed thereto and rotatably supported by the corresponding frame means, said support shafts being adapted to pass stranded filaments longitudinally therethrough to facilitate passage of stranded filaments between said serially related modules, each successive serially related module being adapted to helically strand at least two elongate filaments and guide the stranded filament to the corresponding outlet end thereof while simultaneously receiving any stranded filaments from the adjacent upstream module and guiding them to the corresponding outlet end while maintaining the stranded filaments in separated relation, and means positioned downstream of the last of said serially related stranding modules for cabling all of the strands from said modules.

2. The stranding and cabling system as defined in claim 1 wherein said system includes seven of said stranding modules, said means positioned downstream of the last of said serially related stranding modules comprising cabling means adapted to cable six stranded filaments from said stranding modules about an axially disposed stranded filament from the remaining one of said serially related stranding modules.

3. The stranding and cabling system as defined in claim 2 wherein said means positioned downstream of the last of said serially related stranding modules further includes capstan drive means cooperative with the formed cable to draw the individual stranded filaments from their respective stranding modules.

4. The stranding and cabling system as defined in claim 1 wherein said stranding modules are adapted for positioning in various end-to-end related plan configurations.

5. The stranding and cabling system as defined in claim 1 including three filament supply reels mounted on each of said carriage means in axially aligned relation thereon, said first guide means including means to guide an elongate filament from each of the three filament supply reels on the associated carriage means to said predetermined end of said carriage means.

6. The stranding and cabling system as defined in claim 1 wherein each of said flier guide means includes a pair of axially aligned flier plates rotatably supported by the associated frame means for rotation in planes normal to the longitudinal axis of said frame means, said second guide means including guide pulleys supported by said flier plates and adapted to receive and guide the associated stranded filament from said predetermined end of said carriage means to said outlet end of said frame means.

7. The stranding and cabling system as defined in claim 6 wherein said second guide means further includes guide wires connected to and between said spaced flier plates for guiding at least one stranded filament therealong from an inlet end of said corresponding frame means to an outlet end thereof in separate relation from other stranded filaments guided between said inlet and outlet ends of said frame means.

8. The stranding and cabling system as defined in claim 7 wherein said carriage means includes bearing means rotatably supporting said carriage means interiorly of the path traversed by said guide cables during rotation of said flier guide means so that said carriage means floats relative to the corresponding frame means during rotation of said corresponding flier guide means.

9. A stranding module for stranding a plurality of elongate filaments comprising, in combination, frame means defining a longitudinal axis, flier guide means supported by said frame means for rotation about the longitudinal axis of said flier guide means, carriage means supported by said frame means in floating rotatable relation relative to said frame means and interiorly of said flier guide means so as to enable rotation of said flier guide means while said carriage means remains substantially stationary relative to said frame means, a plurality of filament supply reels mounted on said carriage means in axial alignment and with the axes of said supply reels substantially coincident with the axis of rotation of said flier guide means, each of said supply reels being adapted to support an elongate filament in wound relation thereon, first guide means including a radial let-off flier arm carried by said carriage means in operative association with each of said supply reels for guiding a filament from the corresponding filament supply reel under substantially constant axial tension, said first guide means further including guide pulley means carried by said carriage means for guiding said filaments from said let-off flier arms to substantially the axis of rotation of a predetermined end of said flier guide means, drive means operatively associated with said flier guide means for effecting rotation thereof so as to strand filaments drawn to said predetermined end of said carriage means from said supply reels, and second guide means including a plurality of guide pulleys carried by said flier guide means for guiding a stranded filament from said predetermined end of said flier guide means to the opposite end of said flier guide means.

10. A stranding module as defined in claim 9 wherein said first guide means includes a let-off flier operatively associated with each of said supply reels and operative to receive a filament from its associated supply reel in guiding relation, and guide pulley means carried by said carriage means and operative to guide an elongate filament from each of said let-off fliers to said predetermined end of said flier means.

11. The combination as defined in claim 9 wherein said flier guide means includes axial support shafts rotatably supported by said frame means, at least one of said support shafts enabling passage of at least one stranded filament longitudinally therethrough.

12. The combination of claim 11 wherein both of said support shafts enable passage of at least one stranded filament longitudinally therethrough.

* * * * *

UNITED STATES PATENT AND TRADEMARK OFFICE

CERTIFICATE OF CORRECTION

PATENT NO. : 4,300,339

DATED : November 17, 1981

INVENTOR(S) : John F. Orlandi, et al

It is certified that error appears in the above—identified patent and that said Letters Patent is hereby corrected as shown below:

Column 4, line 15,
Spec., page 7, line 27 "parts" should be --pairs--

Column 7, line 28,
Spec., page 15, line 7 "filter" should be --flier--

Signed and Sealed this

Thirtieth Day of March 1982

[SEAL]

Attest:

GERALD J. MOSSINGHOFF

Attesting Officer

Commissioner of Patents and Trademarks